US006979706B2

(12) United States Patent
Okada et al.

(10) Patent No.: US 6,979,706 B2
(45) Date of Patent: Dec. 27, 2005

(54) LIQUID RAW MATERIAL FOR PRODUCING FORMED POLYURETHANE OR AROMATIC POLYAMIDE, AND USE OF HYDROTALCITE COMPOUND PARTICLES THEREFOR

(75) Inventors: Akira Okada, Kagawa (JP); Koji Shimizu, Kawaga (JP)

(73) Assignee: Kyowa Chemical Industry Co., Ltd., Kagawa (JP)

( * ) Notice: Subject to any disclaimer, the term of this patent is extended or adjusted under 35 U.S.C. 154(b) by 325 days.

(21) Appl. No.: 10/088,658

(22) PCT Filed: Jul. 23, 2001

(86) PCT No.: PCT/JP01/06335

§ 371 (c)(1),
(2), (4) Date: Mar. 20, 2002

(87) PCT Pub. No.: WO02/08123

PCT Pub. Date: Jan. 31, 2002

(65) Prior Publication Data

US 2002/0188060 A1 Dec. 12, 2002

(30) Foreign Application Priority Data

Jul. 24, 2000 (JP) ..... 2000-221762

(51) Int. Cl.[7] ..... C08J 3/00; C08K 3/10; C08L 75/00; C09C 1/02; C09D 1/00

(52) U.S. Cl. ..... 524/436; 106/286.5; 106/286.6; 106/461; 106/463; 106/471; 524/401; 524/437; 524/590; 524/591; 524/839; 524/840

(58) Field of Search ..... 524/590, 591, 524/839, 840, 401, 437, 436, 606; 106/286.5, 286.6, 461, 463, 471

(56) References Cited

U.S. PATENT DOCUMENTS 3,650,704 A 3/1972 Kumura et al.
3,879,525 A 4/1975 Miyata et al.
4,351,814 A 9/1982 Miyata et al.

FOREIGN PATENT DOCUMENTS

| | | |
|---|---|---|
| EP | 0-301509 A1 | 2/1989 |
| EP | 0 558 758 A1 | 9/1993 |
| EP | 0 708 056 A1 | 4/1996 |
| EP | 0 933 401 A1 | 8/1999 |
| EP | 0-952189 A1 | 10/1999 |
| EP | 0-989095 A1 | 3/2000 |
| JP | 46-2280 | 1/1971 |
| JP | 47-32198 | 8/1972 |
| JP | 48-29477 | 9/1973 |
| JP | 50-30039 | 9/1975 |
| JP | 51-29129 | 8/1976 |
| JP | 57-29609 | 2/1982 |
| JP | 59-133248 | 7/1984 |
| JP | 03-292364 | 12/1991 |
| JP | 05-78569 | 3/1993 |
| JP | 10-168657 | 6/1998 |
| JP | 10-168662 | 6/1998 |
| JP | 2000-119510 | 4/2000 |
| JP | 2000-198979 | 7/2000 |

*Primary Examiner*—Patrick D. Niland
(74) *Attorney, Agent, or Firm*—Wenderoth, Lind & Ponack, L.L.P.

(57) ABSTRACT

A dispersion comprising hydrotalcite compound particles having (1) an average secondary particle diameter of 0.1 to 3 $\mu$m as measured by a laser beam diffraction scattering method, (2) a specific surface area of 0.5 to 10 $m^2/g$ as measured by a BET method, and (3) a platy crystal particle shape, and an organic polar solvent; and a dope for polyurethane or aromatic polyamide article.

The present invention has made it possible to provide hydrotalcite compound particles having superior affinity to and dispersibility in organic polar solvents, and a dope having the above particles dispersed therein uniformly, used for production of polyurethane or aromatic polyamide article.

27 Claims, No Drawings

LIQUID RAW MATERIAL FOR PRODUCING FORMED POLYURETHANE OR AROMATIC POLYAMIDE, AND USE OF HYDROTALCITE COMPOUND PARTICLES THEREFOR

DETAILED DESCRIPTION OF THE INVENTION

Technical Field Pertinent to the Invention

The present invention relates to a polyurethane or aromatic polyamide article superior in chlorine resistance and thermal deterioration resistance, as well as to a dope used for production of such an article. More particularly, the present invention relates to a polyurethane or aromatic polyamide article containing hydrotalcite compound particles having a particular shape, as well as to a dope used for production of such an article. The present invention relates also to hydrotalcite compound particles per se, used in such a dope.

Hydrotalcite compound particles are in wide use in resins such as polyurethane, polyvinyl chloride (PVC), polyolefin and polyamide, or in rubbers (elastomers), as an agent for quick halogen capture owing to the anion exchangeability or as an acid-neutralizing agent.

However, with an increase in social requirements for resin products in recent years, the requirements for the high stabilities of resin products to chlorine, heat, light, etc. have become severer. Consequently, it has become necessary that the compounding agents added into resins have superior stabilities to chlorine, heat, light, etc.; and hydrotalcite compound particles used as a stabilizer have been found to have problems to be solved, although they are used in a small amount.

Polyurethane elastic fiber, for example, has high rubber elasticity, superior resiliency and superior mechanical properties such as tensile stress and is therefore widely used in functional clothes. Also, polyurethane elastic fiber is known to show property deterioration, discoloration, etc., caused by chlorine bleaching during washing or water in swimming pool chlorine-sterilized. In order to prevent the above deterioration by chlorine, it is mainly employed to use zinc oxide as an anti-chlorine agent (JP-A-57-29609 and Japanese Patent Application No. 56-93119). However, zinc oxide has a drawback in that it dissolves easily in a dyeing step conducted under an acidic condition.

To alleviate the above drawback, it was proposed to use hydrotalcite compound particles (JP-A-59-133248). The hydrotalcite compound particles are effective as an anti-chlorine agent; however, they have low affinity to and low dispersibility in organic polar solvents used in polymerization and spinning of polyurethane, such as dimethylformamide (DMF), dimethylacetamide (DMAC) and the like. Therefore, many improvements have been proposed.

For example, use of hydrotalcite compound particles having an average particle diameter of 1 $\mu$m or less, surface-treated with a higher fatty acid and/or a silane coupling agent was proposed in JP-A-3-292364; and use of hydrotalcite compound particles surface-treated with a fatty acid having 10 to 30 carbon atoms was proposed in JP-A-5-78569. In JP-10-168657 and JP-A-10-168662, it was proposed to use hydrotalcite compound particles finely ground by beads mill grinding (or attrition) and/or basic metal aluminum hydroxy compound particles after or without coating with a surface-treating agent such as anionic surfactant, fatty acid, silane, poly(organic siloxane) or poly(organic hydrogen siloxane).

Hydrotalcite compound particles surface-treated with a higher fatty acid are in use as an anti-chlorine agent for polyurethane fiber. However, these hydrotalcite compound particles have low compatibility with the organic polar solvent exemplified by dimethylformamide, dimethylacetamide or dimethyl sulfoxide used in the polymerization or spinning of polyurethane; therefore, the hydrotalcite compound particles are subjected, prior to the use, to wet grinding in the organic solvent for a long time to make them fine and dispersible. Nevertheless, their problem of passability through screen mesh is not completely solved and the hydrotalcite compound particles are in use as an anti-chlorine agent, only in limited grades of polyurethane fibers.

The above wet grinding destroys parts of the crystal surfaces of hydrotalcite compound particles; the destroyed parts become crystal defects and act as new active sites; these crystal defects interact with other organic additives such as antioxidant, which may incur coloring, or the crystal defects invite higher solubility, which may incur strong discoloration in the tannin solution treatment conducted after dyeing.

Further, crystal defects compensate each other, promoting agglomeration of hydrotalcite compound particles, which may incur a problem of inferior passability through screen mesh. Furthermore, crystal defects become sites of water adsorption, which may incur problems of, for example, swelling caused by water adsorption.

Aromatic polyamide film or fiber has very high strength and rigidity and therefore is processed into industrial reinforcing material, bulletproof vest, etc. Chlorine resistance and thermal deterioration resistance are required for this film or fiber as well as required for polyurethane.

A study was made in order to solve these problems. As a result, it was found out that the shape, particle diameter and specific surface area of hydrotalcite compound particles interact with each other and have effects on dispersibility, thermal deterioration resistance, chlorine resistance, properties, etc. It was also found out that by specifying the values of the shape, particle diameter and specific surface area, there can be obtained a stabilizer of high dispersibility superior in thermal deterioration resistance, chlorine deterioration resistance, processability, discoloration resistance, fading resistance, alleviation of load to environment.

Tasks to be Achieved by the Invention

The main object of the present invention is to provide hydrotalcite compound particles which can be easily dispersed in an organic polar solvent without being subjected to wet grinding, and also to provide hydrotalcite compound particles which are preferably used particularly when added to various polymers, etc. as a stabilizer by first being dispersed in an organic polar solvent and then mixed with a polymer or the like and, when used, in particular, as an anti-(chlorine deterioration) agent to polyurethane fiber, are easily dispersed in an organic polar solvent and cause, during the production process of polyurethane fiber, no problem such as coloring, discoloration or mesh plugging.

Other objects of the present invention are to provide a resin composition which comprises the above hydrotalcite compound particles, a resin, a dye, etc., which shows no deterioration of resin property, and which can give an article free from thermal deterioration, chlorine deterioration or the like; and an article produced from such a resin composition.

Means for Achieving the Tasks

Many of the problems appearing when hydrotalcite compound particles are used as an anti-chlorine agent for polyurethane, stem from a fact that the hydrotalcite compound particles have low compatibility with organic polar solvents such as DMF and DMAC and inferior dispersibility therein. The problems are aggravated when long-hour wet grinding is conducted for improved dispersibility. Hence, a study was made on hydrotalcite compound particles which are easily dispersed in organic polar solvents with ordinary stirring alone without conducting wet grinding, or hydrotalcite compound particles of strong crystal structure which show no change in crystal surface even when subjected to wet grinding. As a result, the present invention has been completed.

The study revealed that in order for hydrotalcite compound particles to have superior dispersibility and show striking abilities in chlorine deterioration resistance, etc., the particle diameter, specific surface area and shape of the hydrotalcite compound particles have influences and, accordingly, the hydrotalcite compound particles capable of giving a composition wherein the particles are dispersed highly in a resin and which is extremely low in chlorine deterioration, must have a shape satisfying particular conditions.

According to the present invention, there is provided a dispersion comprising (A) hydrotalcite compound particles having
  (1) an average secondary particle diameter of 0.60 to 3 μm as measured by a laser beam diffraction scattering method,
  (2) a specific surface area of 0.5 to 10 $m^2/g$ as measured by a BET method, and
  (3) a platy crystal particle shape, and (B) an organic polar solvent.

According to the present invention, there is also provided a dope for dry or wet production of polyurethane or aromatic polyamide article, comprising (A) hydrotalcite compound particles having
  (1) an average secondary particle diameter of 0.60 to 3 μm as measured by a laser beam diffraction scattering method,
  (2) a specific surface area of 0.5 to 10 $m^2/g$ as measured by a BET method, and
  (3) a platy crystal particle shape, (B) an organic polar solvent, and (C) a polyurethane or an aromatic polyamide.

According to the present invention, there is also provided a polyurethane fiber, an aromatic polyamide fiber or an aromatic polyamide film, all produced from the above dope by a dry or wet method.

The present invention is described in more detail below.

The hydrotalcite compound particles used in the present invention have an average secondary particle diameter (MV) of 0.60 to 3 μm, preferably 0.8 to 2 μm, more preferably 1.0 to 1.5 μm as determined from the particle size distribution measured by a laser beam diffraction scattering method. As the average particle diameter is larger, the particles have higher dispersibility in organic polar solvents, and the resulting dispersion has a lower viscosity and is easy to handle. However, the average particle diameter desirably has the maximum value of 3 μm in order to use the hydrotalcite compound particles in fiber and film applications. When the average particle diameter is less than 0.6 μm, the particles tend to agglomerate, and their dispersion in organic polar solvent has a high viscosity and is not easy to handle. Further, when the particles are as necessary subjected to wet grinding, coloring occurs more easily.

The hydrotalcite compound particles of the present invention has a specific surface area of 0.5 to 10 $m^2/g$, preferably 1 to 7 $m^2/g$ as measured by a BET method. As the specific surface area is smaller, the contact area between the particles and the solvent used is smaller and the interaction between them is smaller; therefore, the dispersibility of the particles in the solvent is considered to be higher. When the specific surface area is more than 10 $m^2/g$, the particles tend to agglomerate. Meanwhile, when the specific surface area is smaller than 0.5 $m^2/g$, the particles has too low chemical activity, resulting in deterioration of anti-chlorine property. The specific surface area is desirably 1 to 7 $m^2/g$ from the standpoint of the prevention of chlorine deterioration.

The crystal particle shape of the hydrotalcite compound particles is desirably such a shape that maintains a dispersion of low viscosity, has good passability through mesh, and is not easily broken during wet grinding. Therefore, platy particles are used, and there are preferred hydrotalcite compound particles having a platy crystal particle shape having an average aspect ratio (major axis diameter/thickness) of preferably 1.7 to 8, particularly preferably 2 to 6.

The hydrotalcite compound particles of the present invention are represented by the following general chemical formula (I).

$$Mg_{1-x}Al_x(OH)_2(CO_3)_y(A^{n-})_z.mH_2O \quad (I)$$

In the above formula, x is $0.1<x<0.45$, preferably $0.2<x<0.45$; y and z satisfy $0.9x \leqq (2y+nz) < 1.5x$; m satisfies $0 \leqq m < 1$; and $A^{n-}$ is an n-valent anion other than $CO_3^{2-}$. As preferable examples of the anion, there can be mentioned $NO_3^-$, $Cl^-$, $OH^-$, $SO_4^{2-}$, $SO_3^{2-}$, $S_2O_3^{2-}$, $HPO_4^{2-}$, $PO_4^{3-}$, $HPO_3^{2-}$, $PO_3^{3-}$, $PO_2^-$, $H_2BO_3^-$, $SiO_3^{2-}$, $HSi_2O_5^-$, $Si_2O_5^{2-}$ and organic acid ions.

As to the method for producing the hydrotalcite compound particles of the present invention, there is no particular restriction as long as they satisfy the above-mentioned conditions (1) to (3). The method includes, for example, the following.

The hydrotalcite compound particles of the present invention can be produced by subjecting the hydrotalcite compound particles obtained by the method disclosed in JP-B-46-2280, JP-B-47-32198, JP-B-50-30039, JP-B-48-29477, JP-B-51-29129 or other literature, to, for example, a heat treatment in an aqueous medium.

The hydrotalcite compound particles of the present invention produced as above is desirably washed with water thoroughly. Further, the hydrotalcite compound particles is desirably sufficiently low in content of soluble salts such as hydrochlorides, hydrobromides, nitrates, sulfates, carbonates, borates and bicarbonates of alkali metals and alkaline earth metals, which may react with organic polar solvents.

Furthermore, the content of Pb, Hg, Cd or Sn as considered to give high load to environment, in the hydrotalcite compound particles is advantageously 1 ppm or less in terms of metal.

The hydrotalcite compound particles of the present invention, having a small specific surface area and large crystal particle diameters, are stable crystal particles low in chemical activity, superior in acid resistance, low in amount of dye molecules adsorbed, and subjectable to wet grinding, and are highly dispersible in organic polar solvents.

Therefore, the hydrotalcite compound particles of the present invention can be advantageously used in, for example, dry or wet production of a polyurethane or aromatic polyamide article using an organic polar solvent. That is, the hydrotalcite compound particles are highly dispersible in a dope wherein a polyurethane or an aromatic polyamide is dissolved in an organic polar solvent, and can keep the dispersed state stably.

According to the present invention, there can be produced a dispersion wherein hydrotalcite compound particles are stably dispersed in an organic polar solvent. It is further possible to produce a dope wherein the above dispersion and a polyurethane or an aromatic polyamide are dissolved, and also produce, from the dope, a film or a fiber stably. Thus, it is possible to produce a polyurethane fiber or an aromatic polyamide fiber or film, each having the hydrotalcite compound particles dispersed uniformly in a polymer.

In the present invention, as the organic polar solvent, there can be used those ordinarily used in preparation of a polyurethane or aromatic polyamide solution. There can be preferably mentioned, for example, dimethylformamide (DMF), dimethylacetamide (DMAC), dimethyl sulfoxide (DMSO) and N-methylpyrrolidone (NMP).

The content of the hydrotalcite compound particles in the dispersion of the particles in the organic polar solvent is 10 to 30% by weight, preferably 15 to 25% by weight.

The hydrotalcite compound particles of the present invention have per se excellent affinity to and dispersibility in organic polar solvents. By being surface-treated with a surface-treating agent, effects of the particles are improved not only in the above properties but also in the anti-chlorine property when contained in a polyurethane or aromatic polyamide article.

The surface-treating agent for the hydrotalcite compound particles can be exemplified by higher fatty acids; phosphoric acid partial esters such as mono- or diester between orthophosphoric acid and stearyl alcohol which may be an acid or an alkali metal salt thereof; silane coupling agents represented by the general formula $Y\text{-}Si(OR)_3$ wherein Y is an alkyl group, a vinyl group, an allyl group, an amino group, a methacryl group or a mercapto group, and OR is an alkoxy group; titanate coupling agents such as isopropyl triisostearoyl titanate, isopropyl tris(dioctyl pyrophosphate) titanate, isopropyl tri(N-aminoethyl-aminoethyl)titanate and isopropyl tridecylbenzenesulfonyl titanate; and aluminum coupling agents such as acetoalkoxy aluminum diisopropylate.

Of these, preferred is at least one kind of surface-treating agent selected from the group consisting of higher fatty acids, anionic surfactants, phosphoric acid esters and coupling agents.

Surface coating of the hydrotalcite compound particles using the above-mentioned surface-treating agent can be carried out by a per se known wet or dry method. In carrying out the surface coating by, for example, a wet method, the surface-treating agent is added to a slurry of the hydrotalcite compound particles, in a liquid or emulsion state, followed by thorough mechanical mixing at a temperature up to about 100° C. In carrying out by a dry method, the surface-treating agent is added to the hydrotalcite compound particles being sufficiently mixed by a mixer such as Henschel mixer, in a liquid, emulsion or solid state, followed by thorough mixing with or without heating.

The surface-treated hydrotalcite compound particles are as necessary subjected to means appropriately selected from water washing, dehydration, granulation, drying, grinding, classification, etc., whereby a final product form can be obtained. The desired amount of the surface-treating agent is 10 parts by weight or less, preferably 0.1 to 5 parts by weight per 100 parts by weight of the hydrotalcite compound particles.

In the present invention, the hydrotalcite compound particles can be subjected to surface modification with at least one kind of compound selected from the group consisting of silicon compounds, boron compounds and aluminum compounds.

The surface modification by coating reduces the basicity of the hydrotalcite compound particles and their positive charge; therefore, the coloring and discoloration of the resin can be suppressed.

The surface-modifying agent used for the surface modification can be exemplified by silicon compounds, boron compounds and aluminum compounds. As specific examples, there can be mentioned sodium silicates such as sodium metasilicate, sodium orthosilicate and No. 1, 2 or 3 water glass; lithium silicate; potassium metasilicate; potassium orthosilicate; sodium tetraborate; sodium metaborate; sodium orthoaluminate; potassium orthoaluminate; sodium orthoaluminate; potassium metaaluminate; aluminum chloride; aluminum nitrate; aluminum sulfate; and aluminum phosphate. These surface-modifying agents are used in an amount of 2 parts by weight or less in terms of Si, B or Al, per 100 parts by weight of the hydrotalcite compound particles. The surface-modified hydrotalcite compound particles are further treated with the above-mentioned surface-treating agent and used.

Speaking of polyurethane fiber, for example, its melting point is higher than the decomposition temperature of urethane bond; therefore, it is impossible to produce polyurethane fiber by melt spinning. Hence, polyurethane fiber is produced, for example, by dry spinning of producing a polyurethane by solution polymerization and then extruding the resulting solution into a hot gas current for drying, or by wet spinning of extruding the solution into a coagulating bath. Aromatic polyamide fiber (or film) is produced mainly by a wet method, for the same reason. Since the hydrotalcite compound particles of the present invention are superior in affinity to and dispersibility in organic polar solvents, an article (fiber or film) can be obtained wherein the particles are uniformly dispersed in a polyurethane or an aromatic polyamide. As a result, the hydrotalcite compound particles can exhibit an excellent action as an anti-chlorine agent, in a polyurethane or an aromatic polyamide.

Thus, according to the present invention there are provided (I) a dope comprising (A) hydrotalcite compound particles, (B) an organic polar solvent and (C) a polyurethane, used for dry or wet production of a polyurethane article production; and (II) a dope comprising (A) hydrotalcite compound particles, (B) an organic polar solvent and (C) an aromatic polyamide, used for dry or wet production of an aromatic polyamide article.

In the dope (I), the content of the hydrotalcite compound particles is 0.05 to 5% by weight, preferably 0.1 to 3% by weight; and the content of the polyurethane is 10 to 45% by weight, preferably 20 to 35% by weight.

Meanwhile, in the dope (II), the appropriate content of the hydrotalcite compound particles is 0.05 to 5% by weight, preferably 0.1 to 3% by weight; and the appropriate content of the aromatic polyamide is 5 to 40% by weight, preferably 7 to 30% by weight.

Into the polyurethane and aromatic polyamide, there can be added other additives ordinarily added, such as antioxidant, light stabilizer, ultraviolet absorber, gas stabilizer, coloring agent, matting agent and filler. These additives are added into the dope.

The hydrotalcite compound particles of the present invention are used in the final polyurethane or aromatic polyamide article in an amount of 0.1 to 10% by weight, preferably 0.5 to 5% by weight.

In the present invention, polyurethane refers to a polyurethane ordinarily used in production of elastic fiber, and is a so-called segmented polyurethane consisting of soft segment portions which are, for example, a diol connected by urethane bond and hard segment portions which are, for example, a polyurea between organic diisocyanate and diamine. It is, for example, a polyurethane composed mainly of:

a prepolymer of 1,000 to 3,000 in molecular weight having isocyanate groups at the two terminals, obtained by reacting a polyester diol, a polyether diol, a polycarbonate diol, a polylactone diol, a mixture thereof, or a copolymer thereof with an organic diisocyanate, and a bifunctional active hydrogen compound as a chain extender, exemplified by diamine such as ethylenediamine, propylenediamine, tetramethylenediamine, pentamethylenediamine, hexamethylenediamine, heptamethylenediamine or octamethylenediamine, hydrazine derivative such as hydrazine hydrate, bissemicarbazide or aminosemicarbazide, or low-molecular glycol such as ethylene glycol, 1,3-propylene glycol, 1,4-butane diol, pentamethylene glycol or heptamethylene glycol.

The aromatic polyamide is obtained by reacting an aromatic diamine such as metaphenylenediamine, paraphenylenediamine, 3,4'-diaminodiphenyl ether or 4,4'-diaminodiphenyl ether with an aromatic dicarboxylic acid chloride such as isophthalic acid dichloride, terephthalic acid dichloride. As specific examples, there can be mentioned a polymetaphenylene isophthalamide, a copolymer thereof, a polyparaphenylene terephthalamide and a copolymer thereof.

EXAMPLES

Next, the present invention is described specifically by way of Examples.

The following properties were measured by the following methods and means.

(1) Average Secondary Particle Diameter

Particle size distribution was measured by a laser beam diffraction scattering method, and the MV obtained was taken as average secondary particle diameter.

(2) Aspect Ratio (Major Axis Diameter/Thickness)

Using a scanning type electron microscope JSM-6300 set at a magnification of 50,000, particles whose major axis diameters and thicknesses were measurable, were searched and measured for the diameters and thicknesses. Aspect ratio was taken as major axis diameter/thickness.

(3) BET Specific Surface Area

The amount of adsorbed nitrogen was measured at a liquid nitrogen temperature, and specific surface area was determined therefrom using a BET method.

(4) DMAC Solution Viscosity

A sample of hydrotalcite compound particles was placed in DMAC (dimethylacetamide) (a solvent), followed by stirring for 1 hour using a homomixer, to prepare a 13 wt % DMAC suspension. The suspension was measured for viscosity at 25° C. using a B type viscometer.

(5) Final Settling Volume Ratio

After the viscosity measurement, the DMAC suspension of each sample was transferred into a messcylinder and allowed to stand for about 1 month. Then, the suspension was measured for settling volume. The percent of the settling volume to the volume of the original suspension was taken as final settling volume ratio. Since it is confirmed by the observation using a phase-contrast microscope that a DMAC suspension of smaller settling volume is superior in dispersibility while a DMAC suspension of larger settling volume is inferior in dispersibility, the dispersibility of a sample of hydrotalcite compound particles was expressed by settling volume. A smaller final settling volume ratio means superior dispersibility.

(6) Measurement of Reactivity with Acid by pH-STAT 50 ml of pure water was placed in a 50-ml beaker. The beaker was placed in a thermostat and kept at 37.5° C. In the beaker were set pH meter electrodes and a syringe for 1 N HCl titrant. 500 mg of a sample was added into the beaker with stirring, and the amount of consumed 1 N HCl was recorded against time, with the pH of the reaction system set at 2.0. There was measured a time T25 which was needed for consuming the amount (4.25 ml) of 1 N HCl corresponding to 25 mole % of the sample. A smaller T25 means higher reactivity with acid and a larger T25 means lower reactivity with acid.

(7) $SO_4$ Content

Measured by colorimetry.

(8) Cl Content

Measured by absorptiometry.

(9) $SiO_2$ Content

Measured by quantitative analysis.

Then, the present invention is described in more detail by way of Examples.

Examples 1 to 10 and Comparative Examples 1 to 3

Samples of various hydrotalcite compound particles different in average secondary particle diameter and BET specific surface area were subjected to physical property measurements, chemical analyses and various other tests. The results are shown in Table 1.

TABLE 1

| | Comp. Examples | | | Examples | | | | | | | | | |
|---|---|---|---|---|---|---|---|---|---|---|---|---|---|
| | 1 | 2 | 3 | 1 | 2 | 3 | 4 | 5 | 6 | 7 | 8 | 9 | 10 |
| Average particle diameter (μm) | 0.56 | 0.55 | 0.65 | 0.79 | 0.89 | 0.9 | 0.9 | 1.07 | 0.72 | 1.01 | 1 | 0.85 | 1.36 |
| BET specific surface area ($m^2/g$) | 11.2 | 14.8 | 12.5 | 9 | 7 | 7.7 | 10 | 6.1 | 9.3 | 7.8 | 10 | 9.8 | 9 |
| X | 0.317 | 0.317 | 0.323 | 0.328 | 0.325 | 0.325 | 0.325 | 0.325 | 0.262 | 0.316 | 0.316 | 0.332 | 0.196 |
| $SO_4$ (ppm) | 20 | 259 | 1140 | 250 | 110 | 75 | 88 | 80 | 290 | 150 | 70 | 500 | 300 |
| Cl (ppm) | 13 | 10 | 40 | 32 | 30 | 29 | 15 | 30 | 40 | 60 | 50 | 40 | 70 |
| $SiO_2$ (%) | | | | | | | | | | | 1 | 18.1 | 14.6 |
| Aspect ratio (major axis diameter/ | 8.5 | 9 | 8.1 | 3.4 | 3.9 | 4.5 | 4.3 | 5 | 7 | 6.1 | 5.9 | 3 | 5 |

TABLE 1-continued

| | Comp. Examples | | | Examples | | | | | | | | | |
|---|---|---|---|---|---|---|---|---|---|---|---|---|---|
| | 1 | 2 | 3 | 1 | 2 | 3 | 4 | 5 | 6 | 7 | 8 | 9 | 10 |
| thickness) | | | | | | | | | | | | | |
| ph-STAT T25 (min) | 12.4 | 8 | 9 | 28.6 | 29.8 | 25.6 | 8.5 | 29 | 21 | 25.1 | 23 | 27 | 20 |
| DMAC solution viscosity (cps) | 1090 | 668 | 55 | 7 | 7 | 7.3 | 5.9 | 5 | 7.5 | 7.3 | 17 | 26 | 32 |
| Final settling volume ratio (%) | 95 | 90 | 70 | 22 | 18 | 20 | 16 | 15 | 21 | 22 | 24 | 25 | 27 |

Example 4: Particles obtained by subjecting the hydrotalcite compound particles of Example 3 to dehydration (crystal water removal).
Example 8: Particles obtained by subjecting the hydrotalcite compound particles of Example 7 to surface modification with No. 3 water glass.
Example 9: Hydrotalcite compound particles of the general formula (I) wherein $A^{n-}$ is $HSi_2O_5^{2-}$.
Example 10: Same as above.

Example 11

30.75 g of the hydrotalcite compound particles of Example 2 were weighed in a 300-ml beaker. Thereto was added 236.5 g of DMAC, followed by mixing using a homomixer, at 5,500 to 6,000 rpm for 1 hour, to prepare a hydrotalcite compound particles dispersion [A].

90 parts by weight of a DMAC solution containing 30 parts by weight of a polyurethane was mixed with 10 parts by weight of a phenolic antioxidant using a homomixer, at 5,500 to 6,000 rpm for 1 hour, to prepare a polyurethane [B]. The phenolic antioxidant was IRGANOX 1010, a product of Ciba-Geigy Japan Limited.

Then, 60 parts by weight of the hydrotalcite compound particles dispersion [A] was mixed with 40 parts by weight of the polyurethane solution [B] using a homomixer, at 5,500 to 6,000 rpm for 1 hour, to produce a polyurethane solution [C].

To 90 parts by weight of the DMAC solution was added 10 parts by weight of the polyurethane solution [C], followed by mixing using a homomixer at 5,500 to 6,000 rpm for 1 hour, to obtain a dope for production of polyurethane article, having the following composition.

Composition of Dope for Polyurethane Article

| | |
|---|---|
| Hydrotalcite compound particles | 0.78 part by weight |
| Phenolic antioxidant | 0.4 part by weight |
| Polyurethane | 28.08 parts by weight |
| DMAC | 70.74 parts by weight |

Example 12

A dope for polyurethane article was produced in the same manner as in Example 11 except that the hydrotalcite compound particles of Example 7 were used.

Example 13

A dope for polyurethane article was produced in the same manner as in Example 11 except that the hydrotalcite compound particles of Example 8 were used.

Example 14

A dope for polyurethane article was produced in the same manner as in Example 11 except that the hydrotalcite compound particles of Example 10 were used.

Each of the dopes obtained in Examples 11 to 14 was free from coloring or discoloration, had no problem in through-mesh filtrability, showed no problem such as settling or separation of components after having been allowed to stand for 5 hours, and was stable.

Example 15

108 g of m-phenylenediamine (MPD) and 203 g of isophthalic acid dichloride (IPC) were subjected to low-temperature solution polymerization in 360 g of DMAC. Subsequently, 296 g of a DMAC solution containing 25% by weight of calcium hydroxide ($Ca(OH)_2$), was added thereto for neutralization. Then, 80 g of a DMAC dispersion containing the hydrotalcite compound particles (crystal water-removed) of Example 4 was added, followed by mixing, to obtain a dope for polymetaphenylene isophthalamide article.

The obtained dope had the following composition.

| | |
|---|---|
| Polymer | 22.7 parts by weight |
| Hydrotalcite compound particles | 1.1 parts by weight |
| DMAC | 62.1 parts by weight |

The dope was free from coloring or discoloration, showed no problem such as settling or separation of components after having been allowed to stand for 5 hours, and was stable.

Effects of the Invention

According to the present invention, there can be provided hydrotalcite compound particles easily dispersible in organic polar solvents. Further, there can be provided an anti-chlorine agent used for production of polyurethane or aromatic polyamide article, which is preferably used particularly when added to various polymers, dyes, etc. as a stabilizer by means which would firstly be suspended in an organic polar solvent and then mixed with a polymer or the like and which is easily used without being subjected to wet grinding, causes no appearance or operational problem such as coloring, discoloration or mesh plugging, and gives low load to environment.

What is claimed is:

1. A dispersion comprising (A) hydrotalcite compound particles having (1) an average secondary particle diameter of 0.60 to 3 $\mu$m as measured by a laser beam diffraction scattering method, (2) a specific surface area of 0.5 to 10 $m^2/g$ as measured by a BET method, and (3) a platy crystal particle shape having an average aspect ratio (major axis polar diameter/thickness) of 1.7 to 8, and (B) an organic polar solvent which is at least one selected from the group consisting of dimethylformamide (DMF), dimethylacetamide (DMAC), dimethyl sulfoxide (DMSO) and N-methylpyrrolidone (NMP).

2. A dispersion according to claim 1, wherein the content of the hydrotalcite compound particles is 10 to 30% by weight.

3. A dispersion according to claim 1, wherein the hydrotalcite compound particles have been surface with a surface-treating agent.

4. A dispersion according to claim 1, wherein the hydrotalcite compound particles have been produced without conducting any wet grinding treatment in an organic polar solver.

5. A dope for dry or wet production of polyurethane article, comprising (A) hydrotalcite compound particles having (1) an average secondary particle diameter of 0.60 to 3 $\mu$m as measured by a laser beam diffraction scattering method, (2) a specific surface area of 0.5 to 10 $m^2/g$ as measured by a BET method, and (3) a platy crystal particle shape having an average aspect ratio (major axis diameter/thickness) of 1.7 to 8, (B) an organic polar solvent which is at least one selected from the group consisting of dimethylformamide (DMF), dimethylacetamide (DMAC), dimethyl sulfoxide (DMSO) and N-methylpyrrolidone (NMP), and (C) a polyurethane.

6. A dope according to claim 5, wherein the content of the hydrotalcite compound particles is 0.05 to 5% by weight and the content of the polyurethane is 10 to 45% by weight.

7. A dope according to claim 5, wherein the hydrotalcite compound particles have been surface-treated with a surface-treating agent.

8. A dope according to claim 5, wherein the hydrotalcite compound particles have been produced without conducting any wet grinding treatment in an organic polar solvent.

9. A polyurethane fiber containing (A) hydrotalcite compound particles having (1) an average secondary particle diameter of 0.60 to 3 $\mu$m as measured by a laser beam diffraction scattering method, (2) a specific surface area of 0.5 to 10 $m^2/g$ as measured by a BET method, and (3) a platy crystal particle shape having an average aspect ratio (major axis diameter/thickness) of 1.7 to 8.

10. A polyurethane fiber according to claim 9, wherein the content of the hydrotalcite compound particles is 0.1 to 10% by weight.

11. A polyurethane fiber according to claim 9, wherein the hydrotalcite compound particles have been surface-treated with a surface-treating agent.

12. A dope for dry or wet production of aromatic polyamide article, comprising (A) hydrotalcite compound particles having (1) an average secondary particle diameter of 0.60 to 3 $\mu$m as measured by a laser beam diffraction scattering method, (2) a specific surface area of 0.5 to 10 $m^2/g$ as measured by a BET method, and (3) a platy crystal particle shape having an average aspect ratio (major axis diameter/thickness) of 1.7 to 8, (B) an organic polar solvent which is at least one selected from the group consisting of dimethylformamide (DMF), dimethylacetamide (DMAC), dimethyl sulfoxide (DMSO) and N-methylpyrrolidone (NMP), and (C) an aromatic polyamide.

13. A dope according to claim 12, wherein the content of the hydrotalcite compound particles is 0.05 to 5% by weight and the content of the aromatic polyamide is 5 to 40% by weight.

14. A dope according to claim 12, wherein the hydrotalcite compound particle have been surface-treated with a surface-treating agent.

15. An aromatic polyamide film or fiber containing (A) hydrotalcite compound particles having (1) an average secondary particle diameter of 0.60 to 3 $\mu$m as measured by a laser beam diffraction scattering method, (2) a specific surface area of 0.5 to 10 $m^2/g$ as measured by a BET method, and (3) a platy crystal particle shape having an average aspect ratio (major axis diameter/thickness) of 1.7 to 8.

16. An aromatic polyamide film or fiber according to claim 15, wherein the content of the hydrotalcite compound particles is 0.1 to 10% by weight.

17. An aromatic polyamide film or fiber according to claim 15, wherein the hydrotalcite compound particles have been surface-treated with a surface-treating agent.

18. Hydrotalcite compound particles for dispersion in organic polar solvent which is at least one selected from the group consisting of dimethylformamide (DMF), dimethylacetamide (DMAC), dimethyl sulfoxide (DMSO) and N-methylpyrrolidone (NMP), having (1) an average secondary particle diameter of 0.60 to 3 $\mu$m as measured by a laser beam diffraction scattering method, (2) a specific surface area of 0.5 to 10 $m^2/g$ as measured by a BET method, and (3) a platy crystal particle shape having an average aspect ratio (major axis diameter/thickness) of 1.7 to 8.

19. Hydrotalcite compound particles according to claim 18, which have been surface-treated with a surface-treating agent.

20. Hydrotalcite compound particles according to claim 18, which have been surface-modified with at least one kind selected from the group consisting of silicon compounds, boron compounds and aluminum compounds.

21. Hydrotalcite compound particles according to claim 18, having an average secondary particle diameter of 0.8 to 2 $\mu$m as measured by a laser beam diffraction scattering method.

22. Hydrotalcite compound particles according to claim 18, wherein the proportion of the particles having secondary particle diameters of 5 $\mu$m or more as measured by a laser beam diffraction scattering method is 1% or less.

23. Hydrotalcite compound particles according to claim 18, having a platy crystal particle shape having an average aspect ratio (major axis diameter/thickness) of 2 to 6.

24. A polyurethane fiber according to claim 9 produced from a dope comprising (A) hydrotalcite compound particles having (1) an average secondary particle diameter of 0.60 to 3 $\mu$m as measured by a laser beam diffraction scattering method, (2) a specific surface area of 0.5 to 10 $m^2/g$ as measured by a BET method, and (3) a platy crystal particle shape having an average aspect ratio (major axis diameter/thickness) of 1.7 to 8, (B) an organic polar solvent which is at least one selected from the group consisting of dimethylformamide (DMF), dimethylacetamide (DMAC), dimethyl sulfoxide (DMSO) and N-methylpyrrolidone (NMP), and (C) a polyurethane, by a wet or dry method.

25. An aromatic polyamide film or fiber according to claim 15, produced from a dope comprising, (A) hydrotalcite compound particles having (1) an average secondary particle diameter of 0.60 to 3 $\mu$m as measured by a laser beam diffraction scattering method, (2) a specific surface area of 0.5 to 10 $m^2/g$ as measured by a BET method, and (3) a platy crystal particle shape having an average aspect ratio (major axis diameter/thickness) of 1.7 to 8, (B) an organic polar solvent which is at least one selected from the group consisting of dimethylformamide (DMF), dimethylacetamide (DMAC), dimethyl sulfoxide (DMSO) and N-methylpyrrolidone (NMP), and (C) an aromatic polyamide, by a wet or dry method.

26. A dispersion according to claim 3, wherein the surface-treating agent is at least one kind selected from the group consisting of higher fatty acids, anionic surfactants, phosphoric acid esters and coupling agents.

27. Hydrotalcite compound particles according to claim 19, wherein the surface-treating agent is at least one kind selected from the group consisting of higher fatty acids, anionic surfactants, phosphoric acid esters and coupling agents.

* * * * *